US009327507B2

(12) United States Patent
Stok et al.

(10) Patent No.: US 9,327,507 B2
(45) Date of Patent: May 3, 2016

(54) LIQUID CONTAINER

(71) Applicant: OCÉ-TECHNOLOGIES B.V., Venlo (NL)

(72) Inventors: Estella Stok, Eindohoven (NL); Alyssa Wongkee, Québec (CA)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/829,941

(22) Filed: Aug. 19, 2015

(65) Prior Publication Data

US 2015/0352852 A1 Dec. 10, 2015

Related U.S. Application Data

(63) Continuation of application No. PCT/EP2014/053227, filed on Feb. 19, 2014.

(30) Foreign Application Priority Data

Feb. 20, 2013 (EP) ..... 13155975

(51) Int. Cl.
*B41J 2/175* (2006.01)
*B41J 29/13* (2006.01)
*B65D 35/56* (2006.01)

(52) U.S. Cl.
CPC .... *B41J 2/17513* (2013.01); *B41J 2002/17516* (2013.01)

(58) Field of Classification Search
CPC ..... B41J 2/17503; B41J 2/17513; B41J 2/17556; B41J 2/17573; B41J 2/175; B41J 2002/17516; B65D 83/0038; B67D 7/0216
USPC ..... 347/86, 108; 222/95, 105, 325, 327, 222/514
See application file for complete search history.

(56) References Cited

U.S. PATENT DOCUMENTS

| | | | | |
|---|---|---|---|---|
| 3,847,304 | A * | 11/1974 | Cohen | B67D 7/0216 222/105 |
| 4,991,742 | A * | 2/1991 | Chang | A61M 5/148 222/105 |
| 5,911,716 | A * | 6/1999 | Rake | A61M 5/148 128/DIG. 12 |
| 5,949,460 | A | 9/1999 | Ahn | |
| 7,470,012 | B2 * | 12/2008 | Kojima | B41J 2/17513 347/86 |
| 8,042,925 | B2 * | 10/2011 | Sugahara | B41J 2/1752 347/86 |
| 2006/0221153 | A1 | 10/2006 | Kojima et al. | |
| 2008/0291251 | A1 | 11/2008 | Hattori | |
| 2013/0093821 | A1 | 4/2013 | Ma | |

FOREIGN PATENT DOCUMENTS

| | | | |
|---|---|---|---|
| EP | 0 635 373 | A1 | 1/1995 |
| EP | 0 745 482 | A2 | 12/1996 |
| EP | 0 778 146 | A1 | 6/1997 |
| EP | 0 891 867 | A2 | 1/1999 |
| EP | 1 053 876 | A2 | 11/2000 |
| EP | 2 095 955 | A1 | 9/2009 |
| JP | 2012-183714 | A | 9/2012 |
| WO | WO 2011/150714 | A1 | 12/2011 |

* cited by examiner

*Primary Examiner* — Anh T. N. Vo
(74) *Attorney, Agent, or Firm* — Birch, Stewart, Kolasch & Birch, LLP

(57) ABSTRACT

A liquid container includes a box and a flexible bag accommodated in the box. The flexible bag contains a liquid and has a first end fixed at the box and a second end opposite to the first end and biased in a direction away from the first end by an elastic member. The box has two parts that are telescopically movable relative to one another and are biased apart by the elastic member. The bag is held at one of these parts with its first end and at the other of these parts with its second end.

10 Claims, 3 Drawing Sheets

LIQUID CONTAINER

CROSS-REFERENCE TO RELATED APPLICATIONS

This application is a Continuation of International Application No. PCT/EP2014/053227, filed on Feb. 19, 2014, and for which priority is claimed under 35 U.S.C. §120. PCT/EP2014/053227 claims priority under 35 U.S.C. §119(a) to Application No. 13155975.9, filed in Europe on Feb. 20, 2103. The entire contents of each of the above-identified applications are hereby incorporated by reference into the present application.

BACKGROUND OF THE PRESENT INVENTION

1. Field of the Invention

The present invention relates to a liquid container comprising a box and a flexible bag accommodated in the box. The flexible bag contains the liquid and has a first end and a second end, the first end being fixed at a wall part of the box.

2. Description of Background Art

Liquid containers of this type may, for example, be used for liquid ink for a printer or copier.

JP 2012-183714 A describes an example of such a liquid container. The box, due to its regular shape and rigidity, facilitates handling and storage of the container, while the flexible bag provides a lightweight and liquid-tight enclosure that is easy to manufacture. When the bag is emptied, an elastic member tends to stretch the bag into a flattened state.

EP 2 095 955 A1 discloses an ink cartridge that comprises a container body, a slider that encloses the container body, and an elastic member for urging the container body and the slider apart. Since the walls of the container body are not flexible, the container body does not collapse when the ink is consumed. In order to avoid the development of a vacuum in the container body, it is therefore necessary to permit air to enter into the container body.

SUMMARY OF THE PRESENT INVENTION

It is an object of the present invention to provide a liquid container that is capable of collapsing into a flat state without forming wrinkles in which remnants of the ink would be retained.

In order to achieve this object, the box according to the present invention has two parts that are telescopically movable relative to one another, an elastic member is provided for urging the two parts of the box apart, and said first end of the bag is fixed at one of the parts of the box and said second end of the bag is fixed at the other of the two parts of the box.

When the bag is filled with liquid, the two telescopic parts of the box are in a retracted state, so that no space needs to be reserved, neither inside the box nor outside thereof, for permitting the bag to be stretched. Consequently, the box requires only little space during transport and storage. However, when the bag is being emptied, the elastic member causes the telescopic parts of the box to expand and thereby to stretch the bag into its flat state by drawing the opposite ends of the bag apart from outside. This not only prevents the bag from forming wrinkles, but has the additional advantage that the amount by which the telescopic parts are expanded and, therewith, the amount to which the bag has been emptied, is readily visible from the outside.

More specific optional features of the present invention are indicated in the dependent claims.

In a preferred embodiment, the one of the two parts of the box that is arranged to be telescopically moved out of the other part may have a scale that indicates the relative position of the two parts and, accordingly, the quantity of liquid left in the bag.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
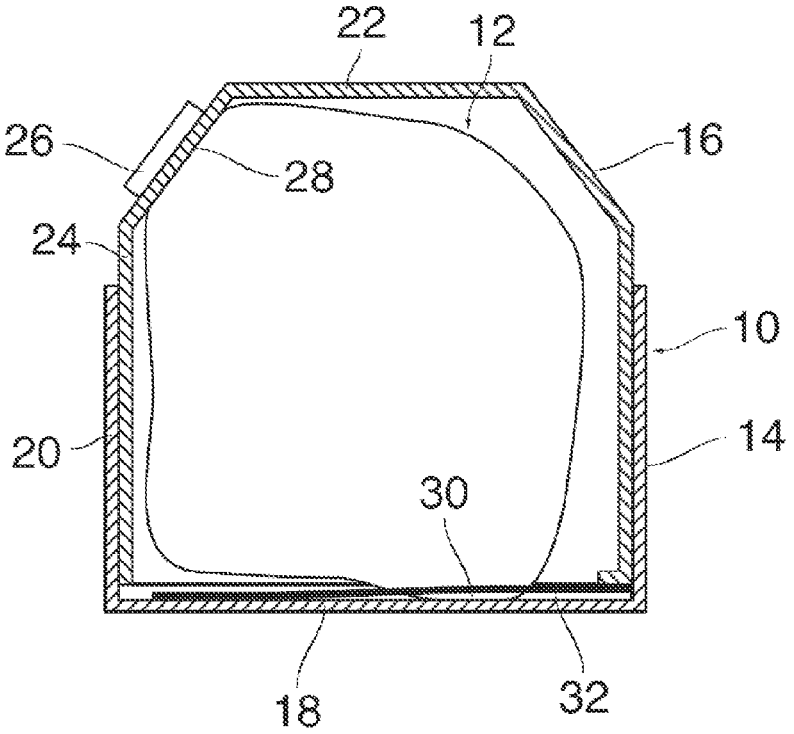
FIG. 1 is a sectional view of a liquid container filled with liquid.

The present invention will now be described with reference to the accompanying drawings, wherein the same reference numerals have been used to identify the same or similar elements throughout the several views.

The ink container shown in FIG. 1 comprises a box 10 that accommodates a flexible bag 12. The bag 12 is filled with a liquid, e.g. with liquid ink, maintenance liquid or media pretreatment liquid for an ink jet printer.

The box 10 has two parts 14, 16 that are telescopically movable relative to one another. The part 14 (bottom part) has a bottom wall 18 and side walls 20. The part 16 (top part) has a roof-shaped top wall 22 and side walls 24 that are held in sliding engagement with the internal surfaces of the side walls 20 of the bottom part 14, so that the top part 16 is guided for vertical movement relative to the bottom part 14.

A spout 26 through which the liquid that is contained in the bag 12 may be withdrawn or poured out is mounted in the top wall 22 of the top part 16, and a first end 28 of the bag 12 is fluid-tightly connected to the spout 26 and thus held rigidly at the top wall 22 of the part 16. An opposite second part 30 of the bag 12 is fixed at the bottom wall 18 of the part 14.

An elastic member 32 is provided for biasing the two parts 14, 16 of the box 10 apart, i.e. for biasing the top part 16 upwardly relative to the bottom part 14. In the example shown, the elastic member 32 takes the form of a coil spring, the windings of which extend along the side walls 20 of the part 14 so that a relatively large hollow space is left inside the spring, permitting the bag 12 to be attached at the bottom wall 18. A lower end of the elastic member 32 is supported on the bottom wall 18 whereas the top end is supported at the lower edge of the side walls 24 of the top part 16.

In the condition shown in FIG. 1, the elastic member 32 is compressed into a flat state. Since the bag 12 is filled with liquid, it tends to retain an inflated state in which the volume is large enough to accommodate the liquid and, correspondingly, the distance between the first and second ends 28, 30 of the bag is relatively short. Since the ends of the bag are attached to the parts 14 and 16, respectively, the bag 12 exerts a tensile force onto the two parts 14, 16 of the box, and this tensile force counterbalances the force of the elastic member 32.

Figure 2:
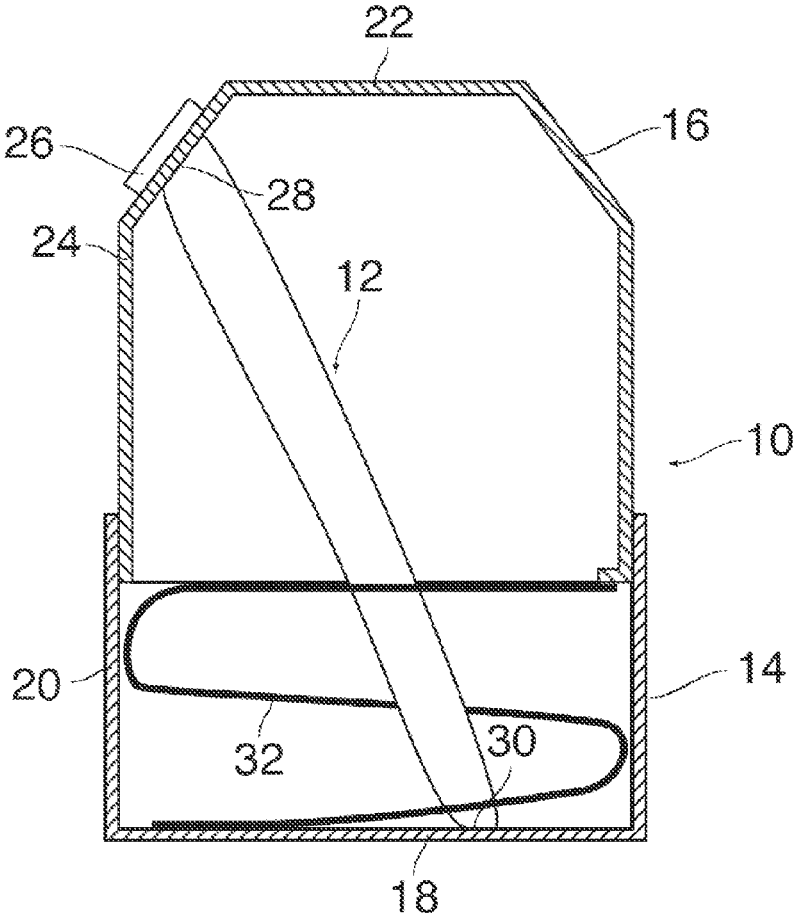
FIG. 2 shows the liquid container of FIG. 1 in the emptied state.

However, when the bag 12 is emptied, it collapses into a flattened state, as has been shown in FIG. 2. This allows the first and second ends 28, 30 of the bag to be drawn apart under the force of the elastic member 32, while the top part 16 of the bag is telescopically moved out of the bottom part 14. In this embodiment, the flattened bag extends approximately along a diagonal plane of the internal cross-section of the box 10.

Figure 3:
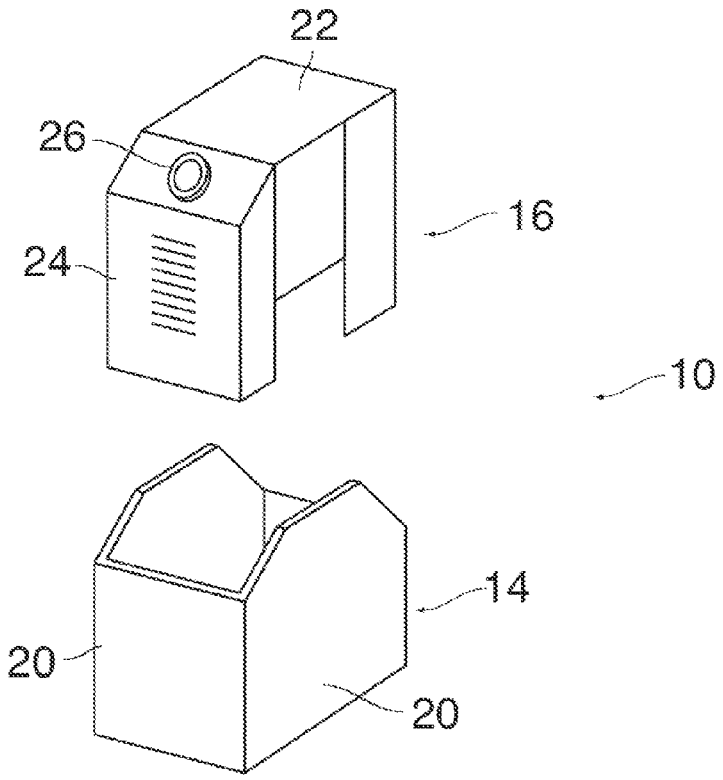
FIG. 3 is an exploded perspective view of a box of the liquid container.

In FIG. 3, the bottom part 14 and the top part 16 of the box 10 have been shown separately. It will be understood that these parts of the box can easily be manufactured, e.g. from cardboard or semi-rigid plastics.

Figure 4:
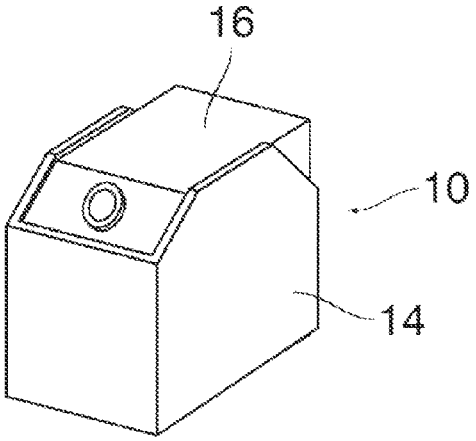
FIGS. 4 and 5 are perspective views of the liquid container in the filled and emptied state, respectively.
Figure 5:
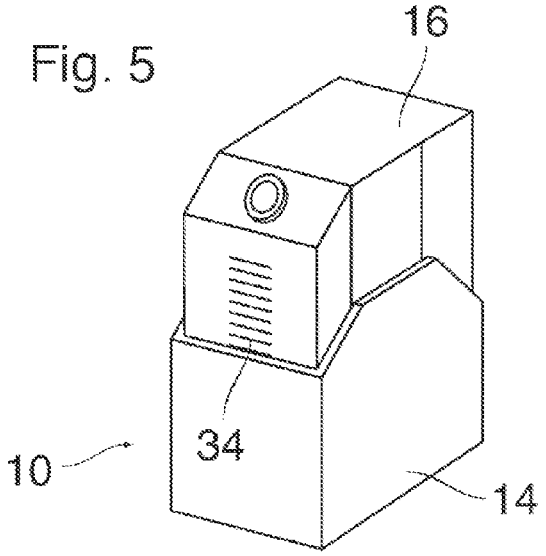

FIG. 4 shows the box 10 in the collapsed state, i.e. in the condition in which the bag inside the box is filled with liquid. FIG. 5 shows the box 10 in an expanded state, when the bag has been emptied to some degree. It can be seen here that one side wall of the top part 16 of the box is provided with a scale 34 that, together with the top edge of the side wall of the bottom part 14, serves as an indicator for the amount of liquid still left in the bag.

It is noted that the terms 'bottom', 'side' and 'top' as used above only indicate the relative positions of the respective walls of the two parts 14, 16 of the box 10 and are not to be used to limit the orientation of the box 10 when used in a printer or printing system.

The liquid contained in the box 10 as shown in FIG. 1 may be emptied out of the liquid container in various ways including using a pump and by gravity.

Figure 6:
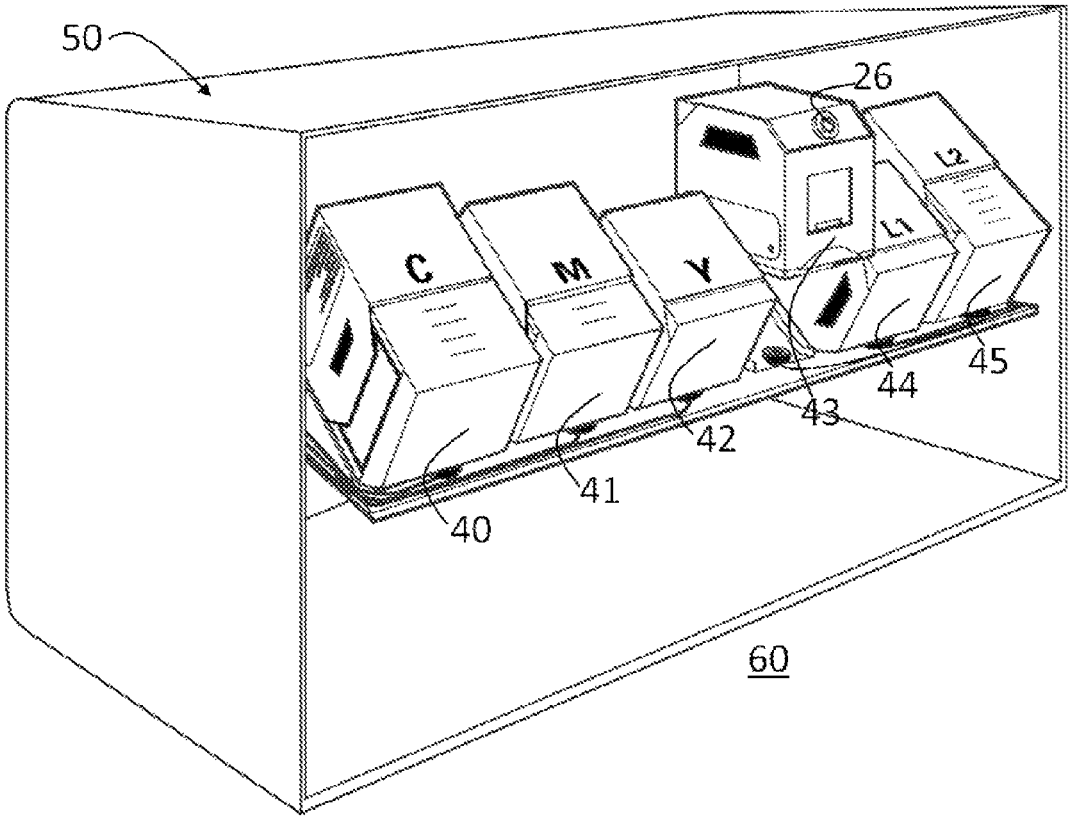
FIG. 6 shows a supply cabinet of a printing system comprising a liquid container according to the present invention.

In FIG. 6, a supply cabinet 50 of a printing system comprising six liquid containers according to the present invention is shown. The liquid containers (40, 41, 42, 43, 44 and 45) respectively contain cyan, magenta, yellow and black ink (CMYK); maintenance liquid, e.g. for flushing ink jet print heads, e.g. indicated with L1 and a primer liquid for pretreating recording substrates, e.g. indicated with L2. In the cabinet, the orientations of liquid containers 40, 41, 42, 44, 45 are such that the spouts of the respective containers are the lowest parts of the liquid containers relative to the floor 60, such that the liquids can be emptied out of the bags by gravity. By comparing liquid containers 40, 41 and 42, it can be noticed that container 40 (cyan) is almost empty; container 41 (magenta) is approximately half full and container 42 (yellow) is almost full. Container 43 (black) is in a "changing position". This position is such that an operator may be able to position a liquid container according to the present invention in the supply cabinet 50 and connect the spout 26 to the printer or printing system, e.g. via a hose (not shown) in an ergonomic way. After establishing a fluid connection between the liquid container and the printer or printing system, the liquid container 43 is tilted in a position similar to the shown positions of liquid containers 40, 41, 42, 44 and 45.

It will be understood that the shape of the top and bottom parts of the box 10 may be varied in various ways. Likewise, the elastic member 32 may have a different configuration. Instead of a compression spring, it would also be possible to use elastic tension elements, e.g. rubber straps that are fixed near the top edge of the side walls of the bottom part 14 with their top ends and near the bottom edge of the side walls of the top part 16 with their lower ends, so that they will lift the top part 16 when they tend to contract. The elastic member 32 may also be externally attached to the box, preferably to the bottom wall 18 with its lower end and to a wall of the supply cabinet with its top end. This configuration may be preferred from a cost point of view: the elastic member in this embodiment is not an integral part of the box and hence does not contribute to the costs of the box. An external elastic member (i.e. not contained within the box) can be reused over and over again.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A liquid container comprising:

a box, said box having two parts telescopically movable relative to one another;

a flexible bag accommodated in the box and capable of containing a liquid, said flexible bag having a first end and a second end, said first end of the bag being fixed at one of the two parts of the box and said second end of the bag being fixed at the other of the two parts of the box; and an elastic member provided for urging the two parts of the box apart.

2. The liquid container according to claim 1, wherein a bottom part of the box has a bottom wall and bottom side walls, and a top part of the box has a top wall and top side walls held in sliding engagement with the bottom side walls of the bottom part, and wherein the first end of the bag is fixed at the top wall of the top part and the second end of the bag is fixed at the bottom wall of the bottom part.

3. The liquid container according to claim 1, wherein each of the two parts of the box has a first side wall on a first side of the box and a second side wall on a second side of the box, the first and second sides being opposite to one another, the first end of the bag is attached to one of the two parts of the box in a position that is closer to the first side than to the second side, and the second end of the bag is attached to the other of the two parts of the box in a position that is closer to the second side than to the first side.

4. The liquid container according to claim 1, wherein one of the first and second ends of the bag is connected to a spout that is formed in a wall of one of the two parts of the box.

5. The liquid container according to claim 1, wherein the elastic member is a spring arranged to press the two parts of the box apart.

6. The liquid container according to claim 1, further comprising an indicator for the fill level of the bag, said indicator comprising a scale on one of the two parts of the box and an edge of a wall of the other part of the box.

7. The liquid container according to claim 2, wherein each of the two parts of the box has a first side wall on a first side of the box and a second side wall on a second side of the box, the first and second sides being opposite to one another, the first end of the bag is attached to one of the two parts of the box in a position that is closer to the first side than to the second side, and the second end of the bag is attached to the other of the two parts of the box in a position that is closer to the second side than to the first side.

8. The liquid container according to claim 2, wherein one of the first and second ends of the bag is connected to a spout that is formed in a wall of one of the two parts of the box.

9. The liquid container according to claim 2, wherein the elastic member is a spring arranged to press the two parts of the box apart.

10. The liquid container according to claim 2, further comprising an indicator for the fill level of the bag, said indicator comprising a scale on one of the two parts of the box and an edge of a wall of the other part of the box.

* * * * *